US006193313B1

(12) United States Patent
Jonsson

(10) Patent No.: US 6,193,313 B1
(45) Date of Patent: Feb. 27, 2001

(54) CHAIR

(75) Inventor: Bertil Jonsson, Sjalevad (SE)

(73) Assignee: Jonber, Inc., Jacksonville, FL (US)

( * ) Notice: Subject to any disclaimer, the term of this patent is extended or adjusted under 35 U.S.C. 154(b) by 0 days.

(21) Appl. No.: 09/415,616

(22) Filed: Oct. 10, 1999

Related U.S. Application Data

(63) Continuation-in-part of application No. PCT/US99/19111, filed on Aug. 20, 1999.

(51) Int. Cl.[7] ..... A47C 1/023

(52) U.S. Cl. ..... 297/284.1; 297/313; 297/337

(58) Field of Search ..... 297/284.1, 284.4, 297/312, 313, 337–339, 322, 330, 344.15, 344.16

(56) References Cited

U.S. PATENT DOCUMENTS

| | | | | |
|---|---|---|---|---|
| 1,698,344 | * | 1/1929 | Mott | 297/337 |
| 1,836,630 | * | 12/1931 | Thum | 297/313 |
| 3,390,857 | | 7/1968 | Nyström . | |
| 4,574,901 | * | 3/1986 | Joyner | 297/337 X |
| 4,589,697 | | 5/1986 | Bauer et al. . | |
| 4,645,159 | | 2/1987 | Terada et al. . | |
| 4,721,337 | | 1/1988 | Tomita . | |
| 4,729,601 | | 3/1988 | Walle et al. . | |
| 4,765,582 | | 8/1988 | Babbs . | |
| 4,787,674 | | 11/1988 | Inaba et al. . | |
| 4,796,951 | | 1/1989 | Tamura et al. . | |
| 4,863,209 | | 9/1989 | Deegener . | |
| 4,966,411 | | 10/1990 | Katagiri et al. . | |
| 4,969,621 | | 11/1990 | Münchow et al. . | |
| 5,035,466 | | 7/1991 | Mathews et al. . | |
| 5,316,370 | * | 5/1994 | Newman | 297/313 |
| 5,467,957 | | 11/1995 | Gauger . | |
| 5,522,641 | | 6/1996 | Infanti . | |
| 5,692,802 | * | 12/1997 | Aujrere et al. | 297/337 |
| 5,871,258 | | 2/1999 | Battey et al. . | |

FOREIGN PATENT DOCUMENTS

| | | | | |
|---|---|---|---|---|
| 1529497 | * | 4/1970 | (DE) | 297/337 |

* cited by examiner

*Primary Examiner*—Peter R. Brown
(74) *Attorney, Agent, or Firm*—Fasth Law Offices; Rolf Fasth

(57) ABSTRACT

A chair that includes a frame, a seat, and a back support that has a lumbar support device to support the back bone of the user. The seat includes a soft cushion and a support panel that includes a front and rear disc part of which the latter protrudes as a free end from the first and is not in contact with the back support. The cushion has a rear seating area that is recessed relative to a forward seating area so that a transition area is formed that provides a knob against which the user's sitting bones may bear against with a view to prevent forward gliding of the user's thigh bones along the seat. The rear disc part is also lowerable from an upper starting position to enable a variation of the height level.

6 Claims, 6 Drawing Sheets

FIG. 10
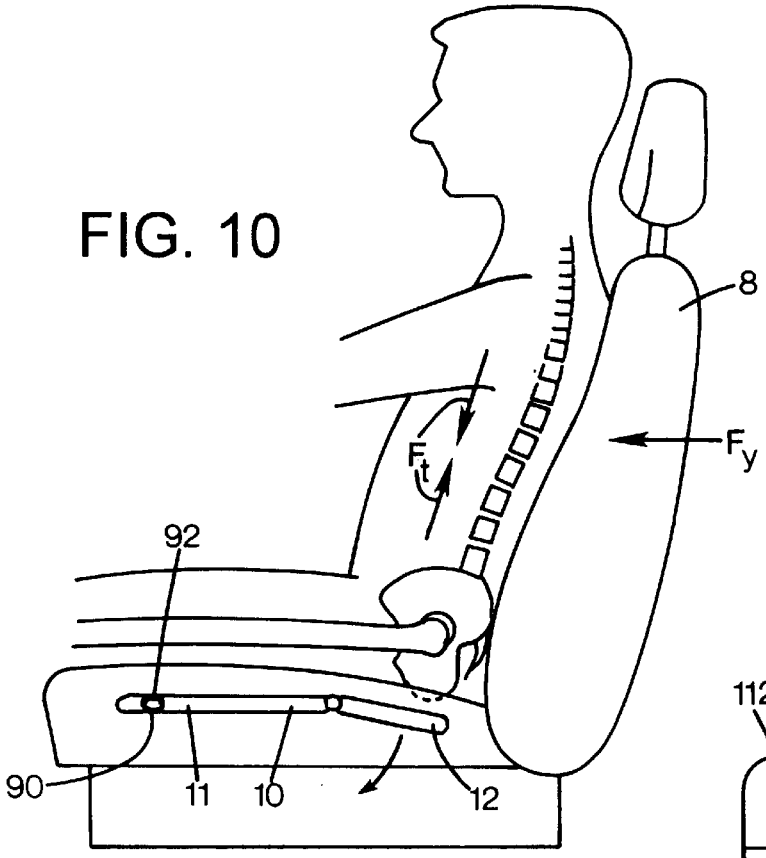
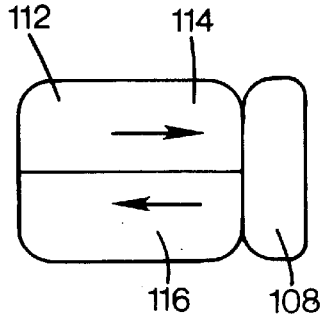
FIG. 12
FIG. 11
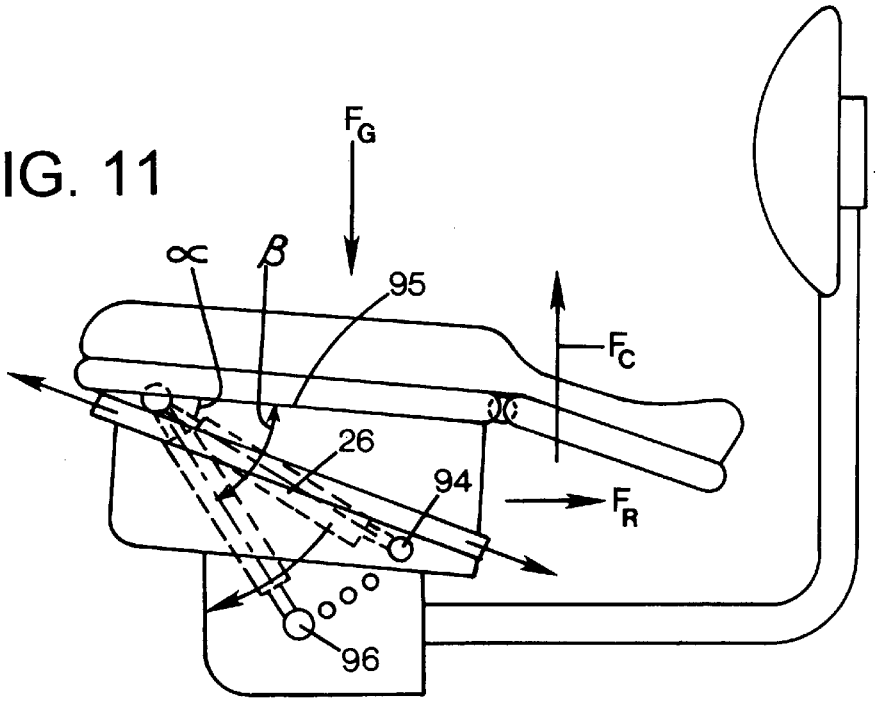

CHAIR

PRIOR APPLICATION

This is a continuation-in-part application of PCT Application No. PCT/US/99/19111, filed Aug. 20, 1999.

TECHNICAL FIELD

The invention relates to a chair that includes a frame and a back support that has a lumbar support device disposed a certain level above the frame to support the user's lumbar spine and/or the pelvis rim (cristae iliaca). The chair also includes a seat that is put together by a support panel that is supported by the frame. The support panel includes the front and back parts, and an upper soft cushion that has a seating area that is recessed relative to a front seating area.

BACKGROUND AND SUMMARY OF THE INVENTION

Chairs that are used for a variety of purposes, such as office chairs, chairs for home use, vehicle chairs or seats etc. sometimes include a special lumbar support device to support the lower back of the user. Usually this device is a softly rounded protrusion or cushion that is disposed on the front of the back support and a certain level above the seat. Below this protrusion, the sitting user may push in his pelvis so that the protrusion bears against the lower back so that the lower back is in an ergonomically desirable, sway-backed or bow shaped position.

A chair that has a support panel that is divided in a front and back part is already known in U.S. Pat. No. 1,836,630. However, that chair has a back support that is non-rotatably attached to the rear part of the support panel. The rear part is non-rotatably attached to the frame of the chair. The fact that the rear part of the support panel and the back support are non-rotatably attached to one another has the consequence that the user risks to slide forwardly along the seat so that the bottom loses is supporting contact with the back support in the area that is below the lumbar support device. In this way, the ergonomically desirable sway-back position of the spine is mediocre. In other words, the body posture of the user becomes wrong and tiresome which can easily create back pain.

A chair of the type described in ingress is also known in U.S. Pat. No. 4,709,961. That chair includes a cushion that is included in the seat and a rear seating area that when the chair is used may be recessed relative to the front seating area. More particularly, by turning the front seating panel upwardly and adjusting its rearward/downward position with an adjustment mechanism against a rear support panel that is sloping. Even in this case, the rear part of the support panel is non-rotatably or unmovably attached to the frame and non-rotatably attached to the back support. This means that the risk for sliding forward along the seat is apparent.

The present invention has the object of solving the above-mentioned problems associated with the earlier known chairs as mentioned above and to create an improved chair. A fundamental object of the invention is thus to create a chair that ensures a lasting and satisfactory support contact between the bottom of the user and the lower part of the back support. Another object is to create a chair that provides a complete support of the user's back against the lumbar support of the back support without requiring that the user must intentionally push in the bottom against the lower part of the back support that is situated below the lumbar support device.

The chair of the present invention is comfortable and easy to adjust to the specific needs of the user. The chair also provides good support for the back of the user. The user of the chair may also move within the chair without losing the good support of the back of the user.

BRIEF DESCRIPTION OF THE DRAWINGS

FIG. 10 is a side view of a fourth embodiment of the chair of the present invention;

FIG. 11 is a cross sectional side view of the first embodiment of the chair; and FIG. 12 is a top view of a fifth embodiment of the seat.

DETAILED DESCRIPTION

Figure 1:
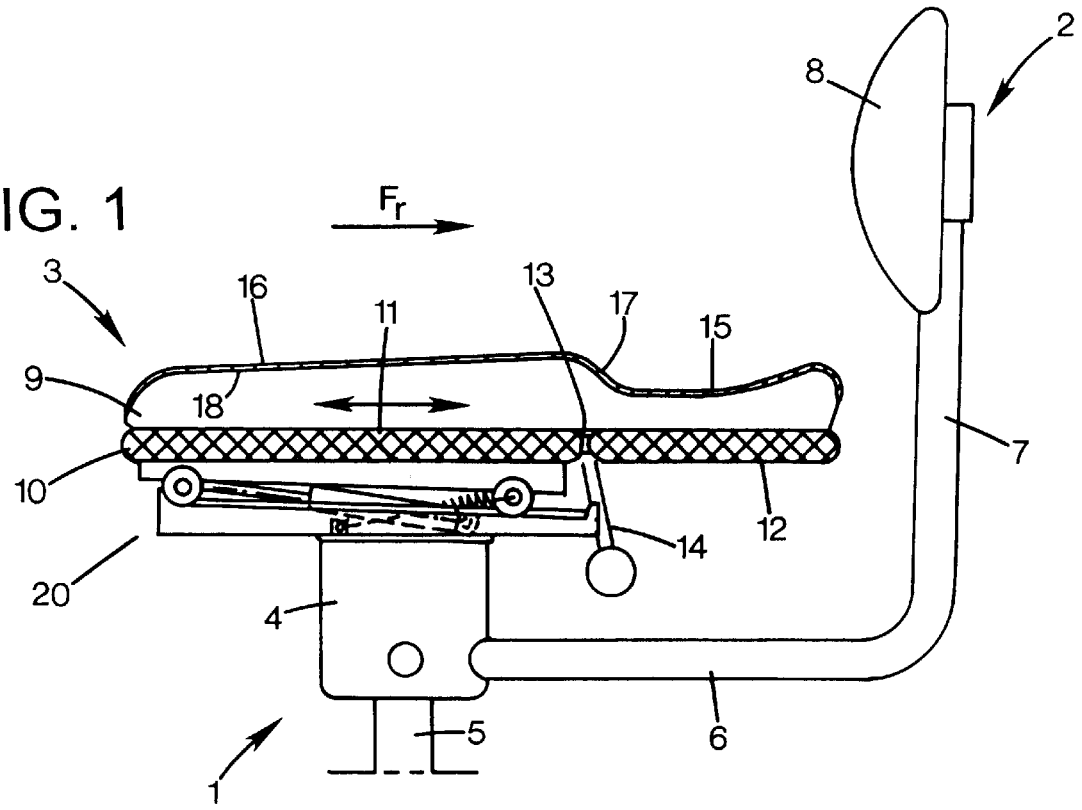
FIG. 1 is a schematic, partly cross-sectional side view showing the chair according to the invention, wherein a support panel that is included in the seat of the chair is shown in a first functional position.
Figure 2:
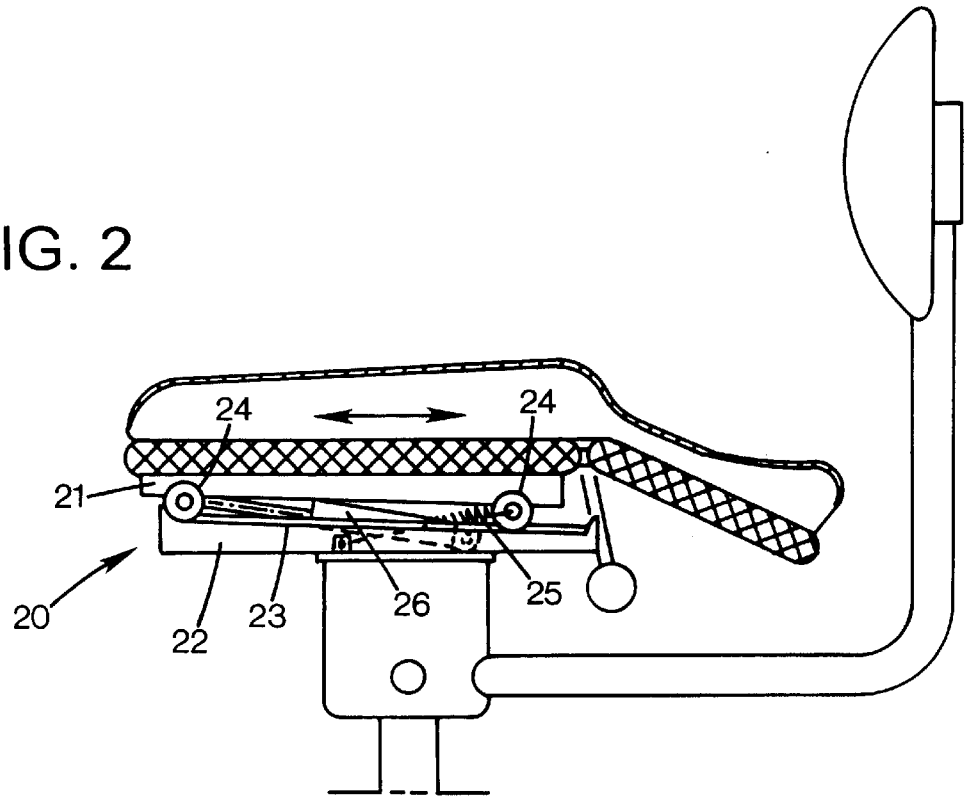
FIG. 2 is an analog side view showing the support panel of the seat in a second functional position.

The chair shown in FIGS. 1 and 2 includes a frame that, as a whole, is referred to with reference numeral 1, a back support 2 and a seat generally referred to with 3. This chair is exemplified in the form of an office chair which frame 1 includes a cylinder shaped support 4 that is disposed on a member 5 that may contain a gas cartridge. The gas cartridge may be attached to a support member on wheels (not shown). The back support 2 has a protrusion 6 that extends from the support 4 and transforms, at its rear end, to a vertical post 7 on which a lumbar support device 8 is mounted. The device 8 is preferably a soft pillow that has a curved front surface.

The seat 3 includes an upper soft cushion 9 and an below is a support panel generally indicated with 10. The support panel 10 includes a front part 11 and a back part 12. Of these parts, the front part is mounted to a member 20 included in the frame 1. The construction and function of the member 20 will be described below. The member 20 is mounted on and is supported by the cylindrical support 4.

As is clearly shown in FIGS. 1 and 2, the back part 12 protrudes backwardly as a free end from the rear edge of the front part 11 and the back part 12 does not have any direct contact with the back support 2. Therefore, the back support may be attached to the frame 1 which, in turn, may be attached to and support the front part 11 of the seat, but not the back part 12. This means that the back part is vertically movable relative to the back support. The embodiment illustrated in FIGS. 1 and 2, the possibility of vertical movement is realized because the back part 12 is rotatable relative to the front part 11. More particularly, it has been contemplated that the back part 12 may be rigidly formed and attached to the front part with one or many mechanical hinges 13 so that both parts are lockable relative to one another at a desired angle with the assistance of a locking mechanism that is not shown in detail but is indicated as a lever 14. In practice, the rear part 12 may be swingable between an upper starting position in which it is situated as a linear extension of the front part that is in one and the same horizontal plane as the front part (as shown in FIG. 1) and in a turned down position (as shown in FIG. 2). The maximum rotational angle is preferably between 50–60 degrees. However, other angles, both greater and smaller, may be used. Although the rotational angle is shown at about 25 degrees in FIG. 2, an angle of about 45 degrees is preferred in practice. As shown in FIGS. 1 and 2, the rear part is shorter than the front part. In practice, the length of the rear part should be about 20–50%, preferably, 25–40% of the whole length of the support panel 10 between the opposite, front and rear end edges. This means that the person sitting in the chair may adjust the angle of the rear part 12 relative to the front part 11 with the lever 14. This angular adjustment may be performed before or after the person has sat down on the seat.

Both parts 11, 12 of the support panel 10 may be made of suitable materials that are of a rigid nature such as plastic, metal or wood (such as plywood). The softer cushion 9 that lays on top may be made of a variety of materials that should have the characteristic of being elastically resilient to provide sit comfort. In practice, it is preferable to use foam rubber.

The rear seat area 15 is, at least when the chair is used, recessed relative to the top side 16 of the rest of the cushion. In this way, the rear seat area 15 is transformed to the front seat area 16 via an upwardly protruding transformation surface 17 that forms a counter point against which the user's sitting bones (tuber ischii) may rest in order to prevent a forward sliding of the thigh bones along the seat and also backward rotation of the pelvis. Preferably, the transformation surface 17 is situated in an area that is vertically above or closely behind the hinge 13 disposed between the rear and front parts 11, 12 of the support panel. This means that the front and rear seating areas 16, 15 on the cushion 9 are provided with substantially the same length as the front part 11 and the rear part 12, respectively. The difference in levels between the seat areas 15 and 16 may vary but should in practice be in the interval 1–40 millimeters, preferably 5–30 millimeters.

It is important that the mentioned the seat areas 15, 16 have a level difference in connection with the situation when the user sits on the seat. However, when the seat is not used, it is not necessary that there is any level difference between the seat areas. This means that the cushion member 9 may be made is different ways. Thus, not only is it possible to shape the cushion so that a pronounced and visible rear recess exits when the seat is not loaded but the cushion may also be formed with a rear material portion that has a lower density than the material in the front portion of the cushion so that the area 15 is recessed relative to the area 16 only when the user sits on the seat.

According to a preferred embodiment of the present invention, the upper side or the outside of the cushion is at least partially covered with a cover 18 that has the characteristic that is creates a resistance to sliding in a forward direction along the cushion but not in the opposite direction. Preferably, plush fabric may be used for this purpose that has fiber elements pointing in a backward direction.

Figure 3:
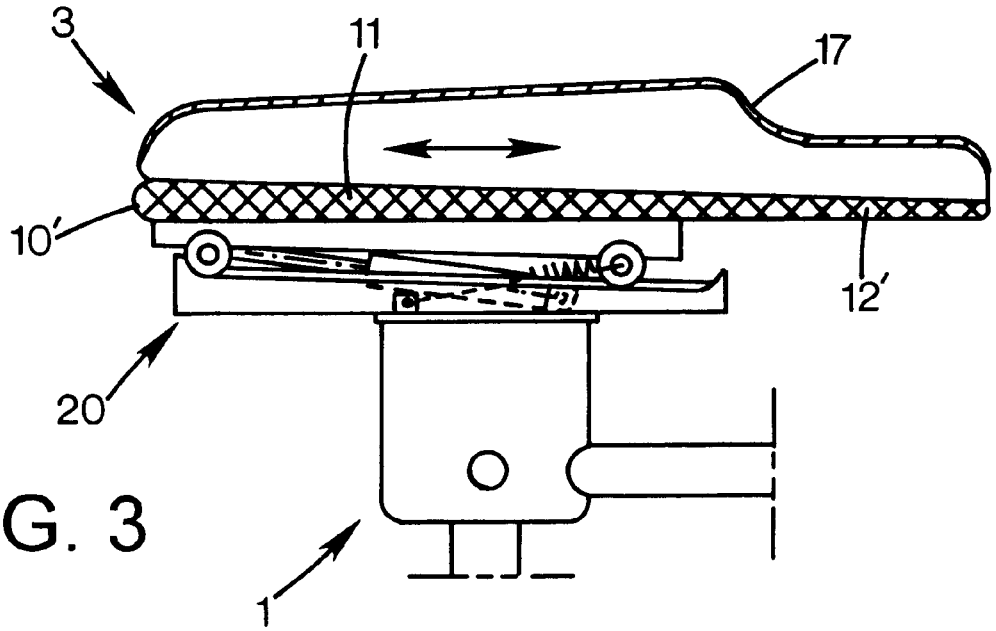
FIG. 3 is a side view that corresponds to FIG. 1 illustrating a second embodiment of the chair seat.
Figure 4:
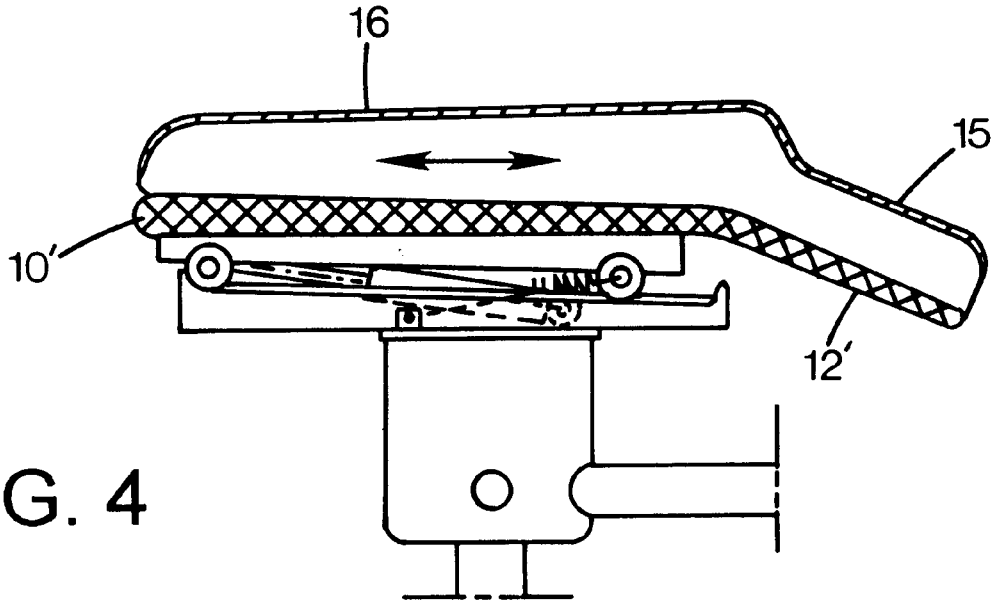
FIG. 4 is an analog side view showing support panel of the seat in a functional position that is different from the position in FIG. 3.

With reference to FIGS. 3 and 4, an alternative embodiment of the seat 3 of the chair is illustrated. In this case, the support panel 10' of the seat is not put together by two separately made and disc parts that are held together by a hinge. Rather, panel 10' is one continuous disc with a rear part 12' that simply protrudes outwardly as a free end from the front disc part 11' which under side is supported by a stiff body that includes the member 20 or the frame 1. The panel 10' is preferably made to have a tapered shape so that it is gradually thinner in a direction towards in rear end. By selecting, in a suitable manner, an elastic resilient material for the panel, the free end and rearwardly protruding part 12' may resiliently bend downwardly from an upper starting position according to FIG. 3 in which the panel as a whole is plane (unloaded position) to a position according to FIG. 4 in which the rear edge of the panel is lowered (loaded position).

Figure 6:
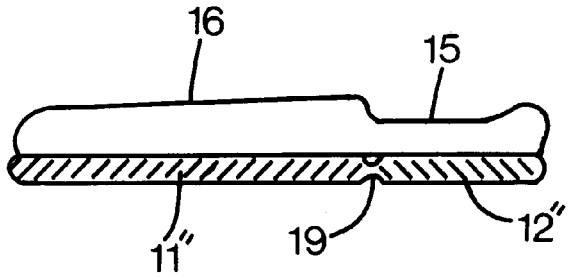
FIGS. 6–7 are simplified side views showing a third embodiment of a seat for the chair.
Figure 7:
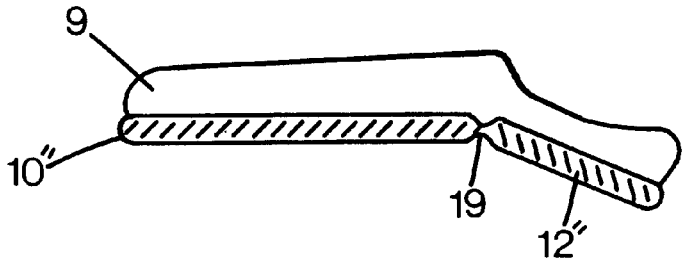

FIGS. 6 and 7 schematically illustrate a support panel 10 that has a substantially even thickness and includes two disc parts or portions 11", 12" that are separated by an indented middle portion 19 that enables the rear disc part 12" to bend downwardly from its original position by being elastically deformed in the material at the middle portion 19.

In this connection, it should also be pointed out that the support panel of the chair seat may have the same thickness along its entire length but be made so that its ability to support is linearly reduced in a backward direction. In this way the rear part may be turned downwardly through a gradual elastic deformation.

According to a preferred embodiment of the present invention, the seat 3 is movable relative to the frame between a forward starting position, on the one hand, in which the seat is at a maximum distance from the back support 2 and this is the normal position of the seat when nobody is sitting on it. On the other hand, the seat may be in a rear end position in which the seat is closer to the back support. More particularly, this position has the purpose of partially pushing the user's pelvis against or under the lumbar support device of the back support. In practice, the movements of the seat between the forward and rear end positions may be done in a substantially horizontal plane although a pronounced slanting plane of movement is possible.

Figure 5:
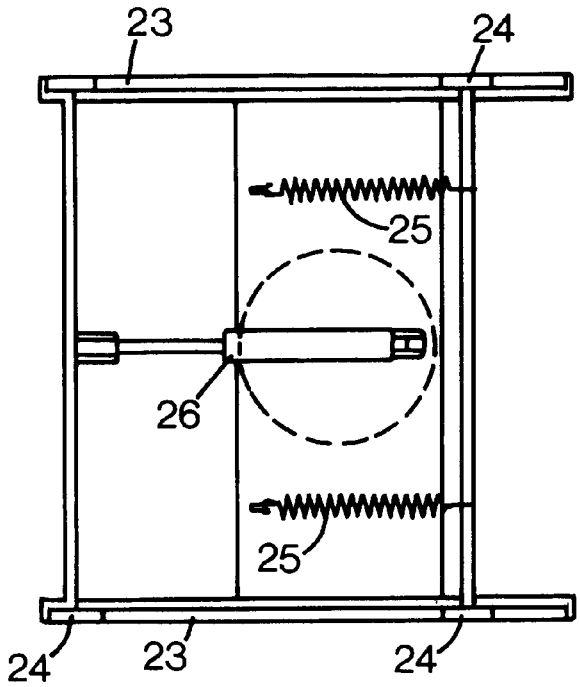
FIG. 5 is a bottom view of the chair seat according to FIGS. 1–4.

According to the embodiments shown in FIGS. 1–4, the above mentioned movements of the seat, the member 20, that is mentioned above, includes a first unit 21 that is associated with support panel 10 of the seat, more particularly the front disc part 11 and an other unit 22 that is associated with the frame 1, more particularly the cylinder shaped support 4. The lower unit 22 includes a sliding plane that at least partially generally slopes in a rearward/downward direction relative the horizontal plane. In the embodiments shown, this sliding plane is realized in the form of straight tracks 23 (also see FIG. 5) and a pair of wheels 24 that are movable therealong. The wheels 24 are preferably rotatably attached to the unit 21. Because the tracks 23 are sloping in the rearward/downward direction relative to the horizontal plane, the seat will, similar to a cart, roll in the backward direction when a user sits on the same. In connection with this, it should also be pointed out that other arbitrary member may be used to provide an automatic movement of the seat in the direction towards the rear end position, such as sliding plates that have a low friction at the contact surfaces or a pair of links between the seat and the frame.

In order to bring back the seat 3 to the unloaded position that is the forward end position, one or many springs 25 may be used that has one end attached to the stationary unit 22 and the opposite end is attached to the movable unit 21. The illustrated embodiment has mechanical pull springs. Gas springs may also be used though.

In the preferred embodiment, the member 20 includes a device to delay the initialization of the movement of the seat against the rear end position for a certain time period after the user has sat down on the seat. For example, the time delay may be between 0.1 seconds and 5 minutes. In general, there is a shorter time delay for office chairs, preferably about 1–2 seconds. Chairs for automobiles require a longer delay such as 5–20 seconds so that the person sits comfortably in the chair before the seat starts moving towards the back support.

In the embodiments illustrated, this device is a pneumatic or hydraulic piston 26 which has opposite ends that are connected with the stationary units 21, 22, respectively. The velocity of the protrusion of the pistons out of the cylinders may be at a maximum of 50 millimeters/minute. However, higher velocities are possible. By using the piston, it is ensured that the user is not uncomfortable because the seat immediately and quickly moves from the original position to the rear end position as soon as he sits on the seat. Thus, the piston ensures a slow and controlled movement of the seat in the direction towards the rear end position.

Figure 8:
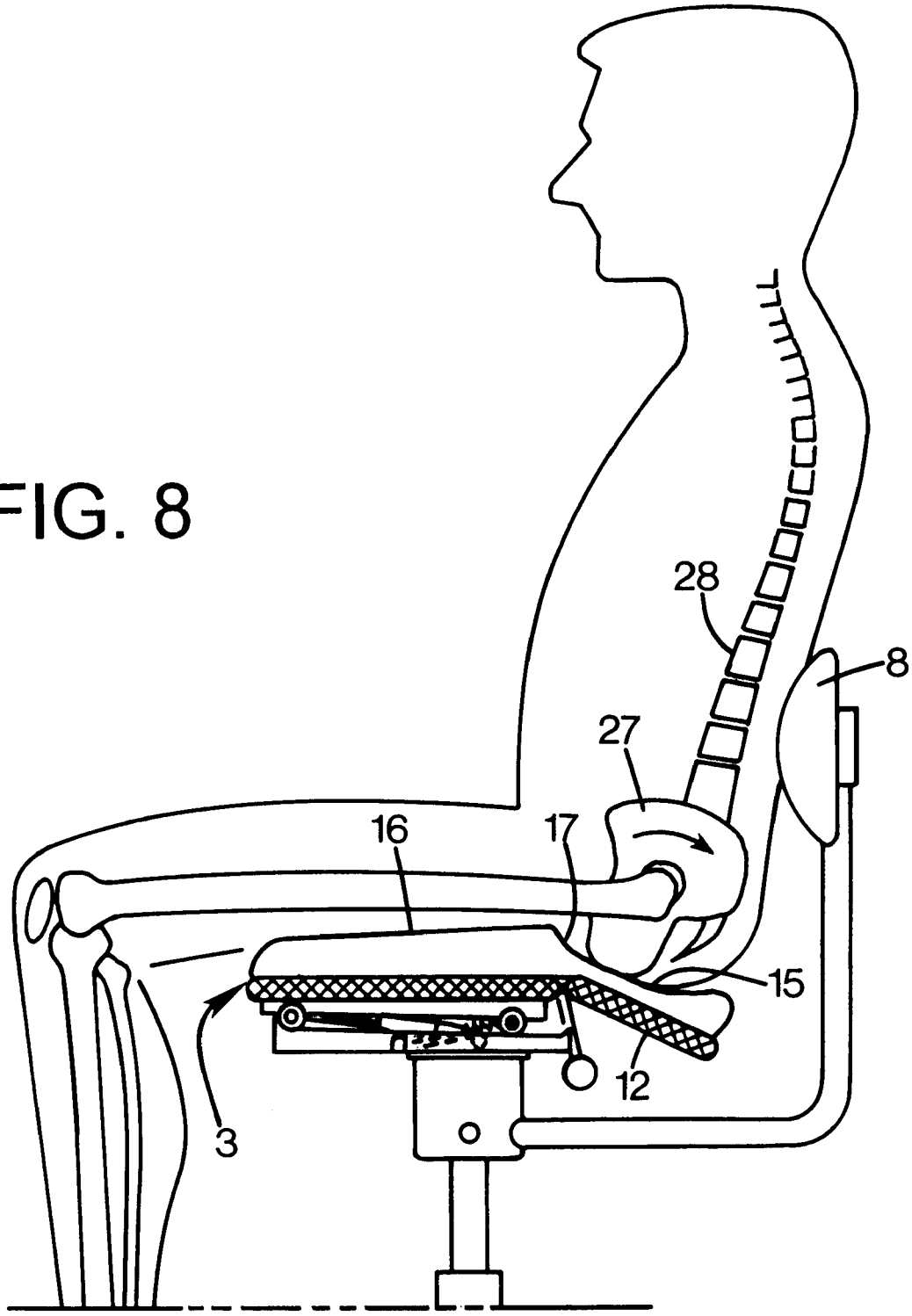
FIG. 8 is a side view showing the chair according to FIGS. 1 and 2 during use, wherein the seat is shown in a forward end position.
Figure 9:
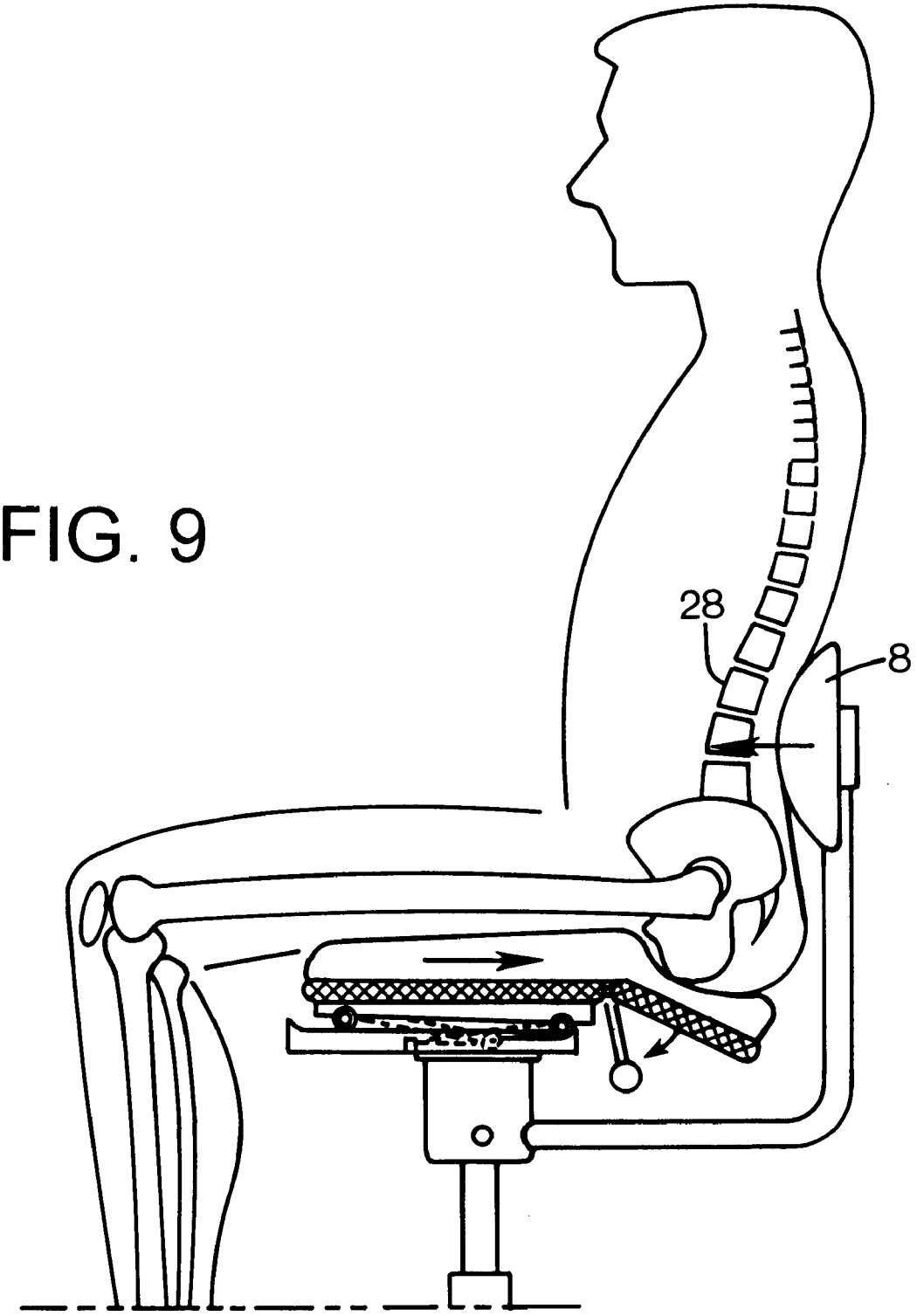
FIG. 9 is an analog side view showing the same seat in a rearward end position.

With reference to FIGS. 8 and 9, the chair's function during use is illustrated. FIG. 8 shows the seat 3 of the chair in the forward end position that is the position of the chair is in, as long as the chair is not in use or just in the moment when the user sits down on the chair. FIG. 8 further shows sitting bones 27 that are positioned above the rear disc part 12 and behind the transition area 17 between the rear and front seating areas 15, 16. FIG. 8 also indicates how the lumbar spine 28 of the user lacks a satisfactory contact pressure against the lumbar support device of the back support. This means that the support members do not provide the desired sway back of the spine. FIG. 9 shows how the seat, after being automatically moved to the rear end position, as a consequence of the weight of the sitting user, ensures that the bottom and the sitting bones 27 are placed closed to the back support in the rear below the lumbar support device 8 so that the lumbar support device will, in a distinct and active way, support the lumbar spine/pelvis rim 28 so that it is in an optimal ergonomical, sway back position.

An important advantage of the present invention is that the user, after an ergonomically optimal body posture has been found, can maintain the body posture for a long time because the seat of the chair effectively prevents the tendency of the thigh bone to slide forwardly along the seat. Also, any backward rotation of the pelvis is prevented in a physiologically desirable way. These desirable effects are obtained regardless if the chair is made to require the user to intentionally shift the bottom against the back support in the area below the lumbar support device or if the chair is designed to provide this backward shifting with the help of the preferred features described above. The latter embodiment is particularly preferable because the user automatically is provided with a complete support of the back as soon as he sits on the seat.

The invention is not limited to the embodiments that have been described above and shown in the drawings. Thus, it is possible to vary the embodiments in many ways regarding the support panel of the seat and its cushion in connection with the geometrical shape and the selection of material of the components. For example, it is possible, via at least one or many, to use a deep transverse groove to divide the cushion into separate cushion parts. Preferably, such a groove is disposed adjacent to the hinge between the front and rear disc part of the support panel. Within the scope of the invention, the rear, free end of the support panel should be able to move in a vertical direction at its rear end. It is also possible to design the disc in many different ways as indicated above.

For example, a vehicle seat that includes three or four point seat belts may be designed so that the rear end of the cushion and the support panel of the seat are provided with an additional downward direction of movement due to activation of the pre-tensioner of the seat belt in connection with a head-on collision or a hit from behind the vehicle to activate the seat belts. When the vehicle is hit from behind, this additional direction provides a reduced vertical compression along the spine and the surrounding substances which in turn reduces the risk for whiplash injuries. If the vehicle is subjected to a head on collision the lowering of the bottom of the user at the rear portion of the seat provides an improved contact between the thigh/bottom and the sliding protection of the seat. This reduces the risk that the user will slide down below the hip seat belt during a head on collision. It should be further pointed out that the automatic rearward shifting of the seat as a whole may be realized in other ways than to rely on the weight of the user.

Thus, it is possible to realize the movements between the front and rear end positions of the seat with a motor 120 such as an electric motor. In such cases, the invention is preferably used in connection with vehicle seats. However, the invention has been exemplified with a seat that has a front starting position that is movable backwardly in the direction towards the back support. It is also possible to design the chair so the back support moves from a rear starting position forwardly towards a stationary seat. It is important to create a relative movement between, on the one hand, the seat and, on the other hand, the back support and the frame attached thereto to achieve the desired sway back. In practice, the distance from the front edge of the seat to the lumbar support device 8 may be adjustable.

It is also possible to make the lumbar support device 8 height adjustable relative to the back support, which is known. Furthermore, it is possible to design the chair with a seat 3 that is adjustable in different angles relative to the movable unit 21 of the frame. In such cases, the seat is provided with a geometrical hinge axle that is disposed adjacent the front edge so that the front disc part of the seat is provided with a device for raising and lowering the rear edge of the front disc part. This embodiment is particularly suitable for so called stand-support sitting and requires a higher seat height and a more open hip angle compared to conventional sitting. The chair may also be provided with a rocking or tilt function for work that requires a backward sloping body posture, for example speaking on the telephone or reading separate papers. In this body position the weight of the body will partially be transferred from the seat to the back support. The reduced seat pressure will make it possible to slide the seat forward relative to the back support while remained seated. This will open up the hip angle. When the seated person returns to an up-right seated position, the seat will automaticaly slide towards the back support as soon as the weight of the body returns to the seat.

One important function of the seat is to prevent any forward sliding of the person sitting on the chair. As mentioned above, this can be achieved by setting a suitable angle of the rear part 12 relative to the horizontal plane with the lever 14 or by deforming the rear part 12'. The deformation of the rear sitting area of the cushion 9, so that the bottom of the user may bear against the transition area 17, also provides a counterpoint to prevent forward sliding of the bottom of the person. The cushion 9 may also be made of a special fabric that resists a forward sliding of the bottom but allows the bottom to slide rearwardly towards to the back support. The total friction force created by the angle of the rear part, the transition area and the special fabric should exceed the forward forces that may be created when the seat is moving in the backward direction towards the back support. In this way, the bottom of the user will not slide forwardly relative to the seat as the seat moves backwardly. The adjustment mechanism of the lever 14 may both be manual or automatic, for example, by deforming the rear part 12'.

Another important function of the support panel 10 is that the downward movement of the support panel 10 at the time of the impact may reduce or prevent whiplash injuries. When a car is hit from behind, the spine of the driver (or passenger) is subjected to both horizontally and vertically directed forces. As best shown in FIG. 10, at the moment of the rear impact a force $F_y$ is generated and the person is pressed into the back support 8. During the recovery when the spine at the chest level of the driver moves forward and is straightened out (while the head remains almost still), the body of the person tends to climb upwardly (ramping) in the chair and be subject to compression forces $F_t$. These forces may, for example, partly depend upon the backward sloping of the back support of the chair and the gravitational forces of the weight of the upper body and the head of the person.

Another reason is that the seat is often relatively stiff in the downward direction. The support panel 10 of the present invention may be provided with a lockable hinge mechanism 90 that is secured with a pin 92 that may be either broken or torn away by an explosion means connected to the pre-tensioner of the seat belt mechanism. The explosion means may, in turn, be set to be triggered when the vehicle is subjected to a violent impact. By tearing away the pin 92, the support panel 10 and, thus, the cushion 9 is free to swing downwardly about the hinge mechanism 90 to remove most of the upwardly directed compression forces $F_t$ on the driver. Additionally, the seat belt may also pull the driver downwardly to counteract the downwardly oriented compression forces $F_t$.

During a head-on collision, the downward compression forces on the body during the impact against the seat belt anti-submarine protection in the front part of the seat may be as high as 30 g, the hinge mechanism 90 substantially reduces the counter acting forces by providing a gradual resistance. The increased downward angle of the support panel 10 also increases the friction forces and makes it more difficult for the bottom of the person to slide forwardly.

As best shown in FIG. 11, the amount of backward force $F_r$ that the sitting person may be subjected to as the person sits down may be adjusted. The backward force $F_r$ partly depends upon the weight (gravitational force $F_g$) of the sitting person if the backward movement of the seat is a function of the gravitational forces of the sloping surface 22. This means that a heavier person will move backwardly quicker than a very light person.

The gas piston 26 may be attached to the member 20 at an upper attachment point 94 to provide a relatively high backward force $F_r$ at an angle alpha relative to a horizontal plane 95. By lowering the attachment point of the piston 26 to, for example, an attachment point 96 at a greater angle beta relative to the horizontal plane 95, the backward force $F_r$ is reduced as a result of the increase in the upwardly directed force $F_c$ that counteracts the gravitational force $F_g$. This means that the attachment point 96 may be more suited for a relatively heavy person or for a light person that only desires a slow backward movement or no backward movement at all.

Of course, the resistance of the piston 26 may also be adjusted without changing the position or angle of the attachment points of the piston 26. For example, the piston 26 may have an adjustment mechanism to adjust both the dampening and return forces of the piston.

FIG. 12 shows an alternative embodiment of a seat 112 having a left side 114 and a right side 116. This embodiment is identical to the earlier embodiments described above with the exception of the seat 112. In other words, the seat 112 may be moved towards the back support 108 as described above. Additionally, the user may then turn sideways on the seat 112 by either moving the left side 114 back and forth relative to the right side 116 or vice versa. The result is that the user may rotate the pelvis slightly in a forward/rearward direction relative to the back support of the chair to reduce fatigue of the spine and back muscles. The above described movements and actions of the seat parts is due to the users own body weight. In a car, these movements of the seat parts can be controlled by one or several electronically controlled motors. This is particularly important in a car seat when the driver sits on the seat for a long time. The result is similar to a conventional office chair that may be rotated about a vertical support stand relative to the back support.

It should be mentioned that the backward movement of the seat 3 may be triggered by ignition of the car, the seat belt buckle or by the forward or backward movement of the vehicle. Other means for triggering the backward movement of the seat 3 may be used, whether automatic or manual.

While the present invention has been described in accordance with preferred compositions and embodiments, it is to be understood that certain substitutions and alterations may be made thereto without departing from the spirit and scope of the following claims.

I claim:

1. A chair comprising:

a frame;

a back support in operative engagement with the frame;

a seat in operative engagement with the frame, the seat comprising a support panel that is supported by the frame, the support panel comprising front and rear parts;

the front part being attached to and supported by the frame and the rear part protruding outwardly as a free end from the front part without being in direct contact with the back support;

a rear seating area being attached to a front seating area via a transition area so that the rear seating area is movable to a position below the front seating area, the front seating area being supported by the frame, the front and rear seating areas being disposed above the support panel;

the rear part being variably lowerable from an upper starting position relative to the back support, the rear part being movably attached to the front part; and an upper side of a cushion being covered with a cover that provides a high resistance against sliding in a forward direction and a low resistance against sliding in an opposite rearward direction.

2. A chair comprising:

a frame;

a back support in operative engagement with the frame;

a seat in operative engagement with the frame, the seat comprising a support panel that is supported by the frame, the support panel comprising front and rear parts;

the front part being attached to and supported by the frame and the rear part protruding outwardly as a free end from the front part without being in direct contact with the back support;

a rear seating area being attached to a front seating area via a transition area so that the rear seating area is movable to a position below the front seating area, the front seating area being supported by the frame, the front and rear seating areas being disposed above the support panel; and the rear part being variably lowerable from an upper starting position relative to the back support, the rear part being movably attached to the front part, the seat being movably attached to the frame, the seat and the frame being movable relative to another between a first position and a second position, the chair further comprises a biasing member in operative engagement with the seat to hold the seat in the first position that is remote from the back support, the seat is movable to the second position adjacent the back support when the seat is subjected to a load and the seat is movable back to the first position when the load is removed.

3. The chair according to claim 2 wherein the chair further comprises a delay mechanism for delaying movement of the seat from the first position to the second position a first time period after the seat is subjected to a load and for providing a controlled velocity of movement of the seat between the first and second position.

4. The chair according to claim 2 wherein a lumbar support device is attached to the back support, the lumbar support device is positioned a first level above the frame.

5. The chair according to claim 2 wherein the rear seating area and the front seating area are a cushion that is disposed above the front and rear parts.

6. The chair according to claim 2 wherein the member comprises a motor.

* * * * *